US005566895A

United States Patent [19]

Otto et al.

[11] Patent Number: 5,566,895

[45] Date of Patent: Oct. 22, 1996

[54] DEVICE FOR CUTTING MEAT

[75] Inventors: Friedrich Otto, Hameln; Friedhelm Eusterbarkey, Bad Pyrmont, both of Germany

[73] Assignee: A. Stephan u. Söhne GmbH & Company, Hameln, Germany

[21] Appl. No.: 354,151

[22] Filed: Dec. 6, 1994

[30] Foreign Application Priority Data

Dec. 7, 1993 [DE] Germany ..... 43 41 606.3

[51] Int. Cl.[6] ..... B02C 18/36

[52] U.S. Cl. ..... 241/82.7; 241/282.2

[58] Field of Search ..... 241/82.4, 82.5, 241/82.6, 82.7, 247, 282.1, 282.2, 186.35

[56] References Cited

U.S. PATENT DOCUMENTS

| | | | |
|---|---|---|---|
| 2,655,957 | 9/1995 | Mallory | 146/182 |
| 4,606,505 | 9/1995 | Simonsen | 241/82.5 |
| 5,289,978 | 9/1995 | Lundquist | 241/57 |

FOREIGN PATENT DOCUMENTS

| | | | |
|---|---|---|---|
| 2589754 | 5/1987 | France . | |
| 51091 | 6/1889 | Germany . | |
| 886703 | 8/1953 | Germany . | |
| 2059522 | 6/1972 | Germany . | |
| 2100939 | 7/1972 | Germany . | |
| 2332042 | 2/1974 | Germany . | |
| 2432112 | 1/1976 | Germany . | |
| 3833515 | 4/1990 | Germany . | |
| 1533761 | 9/1995 | Russian Federation | 241/82.5 |
| 294009 | 1/1954 | Switzerland . | |
| WO9320987 | 10/1993 | WIPO . | |

*Primary Examiner*—Frances Han

*Attorney, Agent, or Firm*—Whitham, Curtis, Whitham & McGinn

[57] ABSTRACT

The invention relates to a device for cutting frozen pieces of meat. According to the invention, provision is made for continuously cutting these pieces of meat in a rotating set of cutters with minimum heat absorption and minimum possible emulsification to achieve a grain size of 2 to 8 mm.

12 Claims, 11 Drawing Sheets

DEVICE FOR CUTTING MEAT

The invention relates to a device for cutting pieces or edible products, especially pieces of meat frozen to about −9° C.

Known comminuting machines include bowl cutters, meat grinders, rebound crushers, grinders, and cube cutters.

In the cutter mentioned above, a set of cutters operates at different but always high rotational speeds in a rotating circular trough-shaped bowl. The material in the trough is continuously fed to the set of cutters by the rotation of the bowl. The main disadvantage of this device is that it can be operated only discontinuously.

On the other hand, meat grinders operate continuously and are offered on the market for high tonnages and also for grinding frozen meat. The cutter system composed of the feed screw, curing blades, and perforated disk exhibits relatively high friction, so that the grinding process results in a higher application of energy and hence causes heating of the product, in turn resulting in incipient emulsification, in other words a bonding of the product.

Rebound crushers are used particularly in chemistry and pharmacy but also for processing nuts and seeds, cocoa beans for example. The product to be ground is flung at high speed against hard fixed or rotating grinding tools. In such rebound mills, pieces of meat would be torn to pieces and crushed instead of being cut up.

Continuously operating grinders are known (see for example German Patent 28 23 245) that are provided with a rotor-stator system that rotates at high speed and operates with zero contact. These high-speed cutting systems are designed both for cutting and for emulsification. The degree of emulsification that is usually desired when these machines are used, as far as the resultant product is concerned, cannot be avoided. These grinders are used in particular for products with a particle size of less than 2 mm.

Cube cutters can only be used to make pieces of product with an edge length of 10 mm or more; their design is also unsuitable for meat grinding processes.

All previously known machines have one thing in common: an unsatisfactory price/performance ratio as far as continuous meat cutting processes are concerned.

The goal of the invention is to develop a device with which frozen pieces of meat in particular can be reduced further in size in a continuous process.

This goal is achieved according to the invention by the following features:

a) cutter sets rotating in a cutter housing are mounted on the horizontal shaft stub of a three-phase motor, or on a stub that is inclined to the horizontal, said cutters being mounted nonrotatably but readily replaceably, with axial spacing between them;

b) each set of cutters has an axial conveyor component;

c) the cutter sets operate at rotational speeds between 500 and 3000 rpm;

d) the cutter sets are designed in terms of their configuration as well as their axial distances from one another such that frozen pieces of meat with an edge length of 250×250×250 mm are cut with minimum possible heat absorption with a minimum possible emulsification component to a grain size of 2 to 8 mm (meat granulation);

e) in its lower area, the cutter housing has a delivery opening open at the bottom for continuous granulated meat delivery under the influence of gravity;

f) as viewed in the axial direction, the cutter housing is preceded by a continuously operating feed device for the pieces of meat, which lends the pieces of meat a delivery component directed opposite the plane of rotation of the first cutter set.

When reference is made in the claims to meat, it refers only to a product that also includes entrails for example. Other products such as nuts and seeds, fruit, vegetables, or the like are possible. "Edible products" also means animal feed, such as pet food for example.

An important feature of the invention lies in the continuous method of operation. The cutting machine according to the invention can thus be simply integrated into existing continuously operating lines. In addition, the granulation of the pieces of meat that are supplied to produce a relatively small grain size is also important to the invention, with this cutting process being preformed with as low an energy input as possible so that the end product is granular to pourable and has a closely defined grain size. In contrast to known methods and devices, therefore, a product is prepared with the minimum possible degree of emulsification.

The pieces of meat that constitute the raw material usually have a shorter edge length than the maximum figure given above; a so-called dust component can also be present. The raw material can also have temperatures in the vicinity of the freezing point so that the material can be referred to as thawed.

To change the product throughput and/or the fineness of the product granulation, the cutting tools can be modified according to the invention in terms of their rotational speed, diameter, geometry, number, and/or axial distance from one another. This also makes it possible to influence the accuracy of the cutting or the cutting process. It is therefore advantageous for the cutting tools to be readily interchangeable.

The delivery of the pieces of product into the vicinity of the rotating sets of cutters is performed continuously through a feed screw, a conveyor belt, or a gravity conveyor. By adjusting the output, the fineness of the end product could be affected as well.

A three-phase motor can likewise be provided as a drive for the feed screw and/or conveyor belt, whereby said motor, like the three-phase motor for the sets of cutters, can be fitted with a frequency converter ahead of it to regulate the rotational speed. With the Kohl numbers in mind, however, two or three rotational speeds can also be provided without using a frequency converter.

When a feed screw is used, the product throughput and quality, in other words the fineness and granularity of the resultant end product, can be affected by changing the rotational speed, the screw diameter, and/or the screw pitch.

Thanks to its simple design, the device according to the invention can be adjusted very quickly to produce the end product desired by the customer by replacing the blades and varying the rotational speed. The machine is simple in design and therefore only slightly prone to difficulties. It meets hygienic requirements for food processing, can be integrated smoothly into existing lines, has compact dimensions, and can also be arranged in parallel or, when very high degrees of granulation are required, in tandem. The design is especially suited for high throughputs of 40,000 kg per hour for example, but permits very much lower outputs of only 1000 kg/h for example. The price/performance ratio relative to machines currently on the market is very favorable because of the design.

Further features of the invention are the subjects of the subclaims and will be described in greater detail in conjunction with further advantages of the invention with references to embodiments.

The drawing shows several embodiments of the invention intended as examples.

Figure 1:
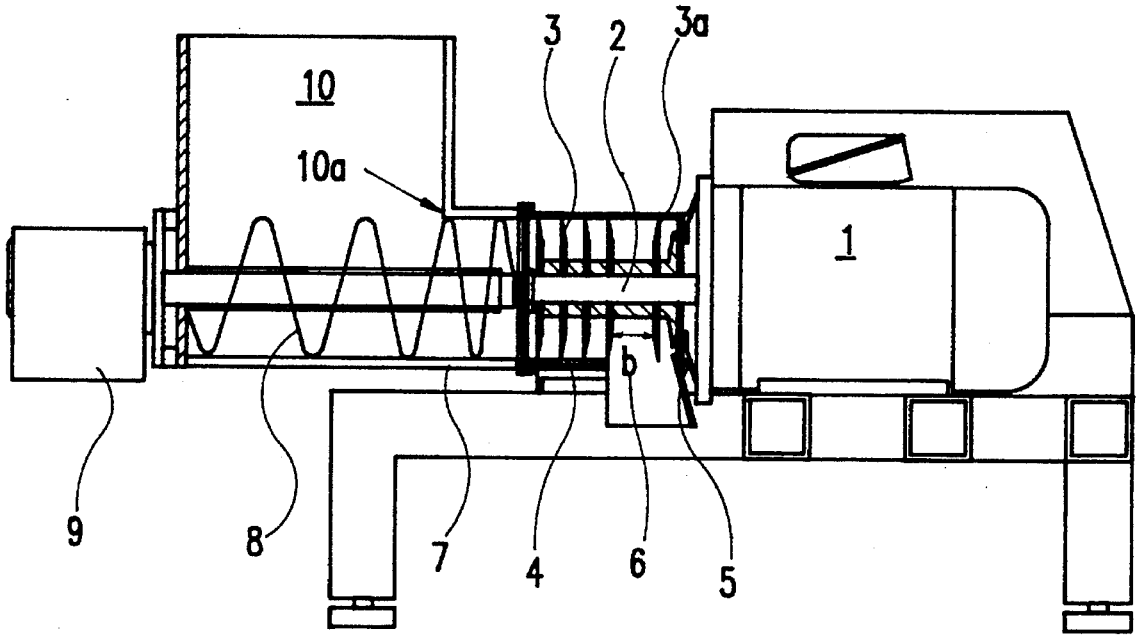
FIG. 1 is a cutting machine in a perpendicular lengthwise section.
Figure 2:
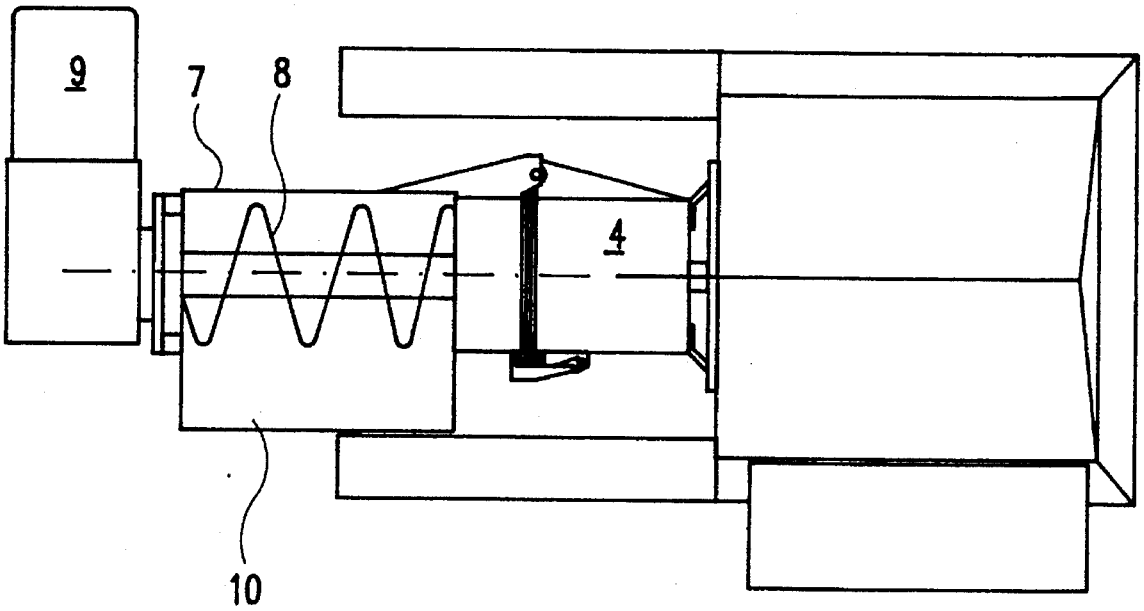
FIG. 2 is the item in FIG. 1 in a top view.
Figure 3:
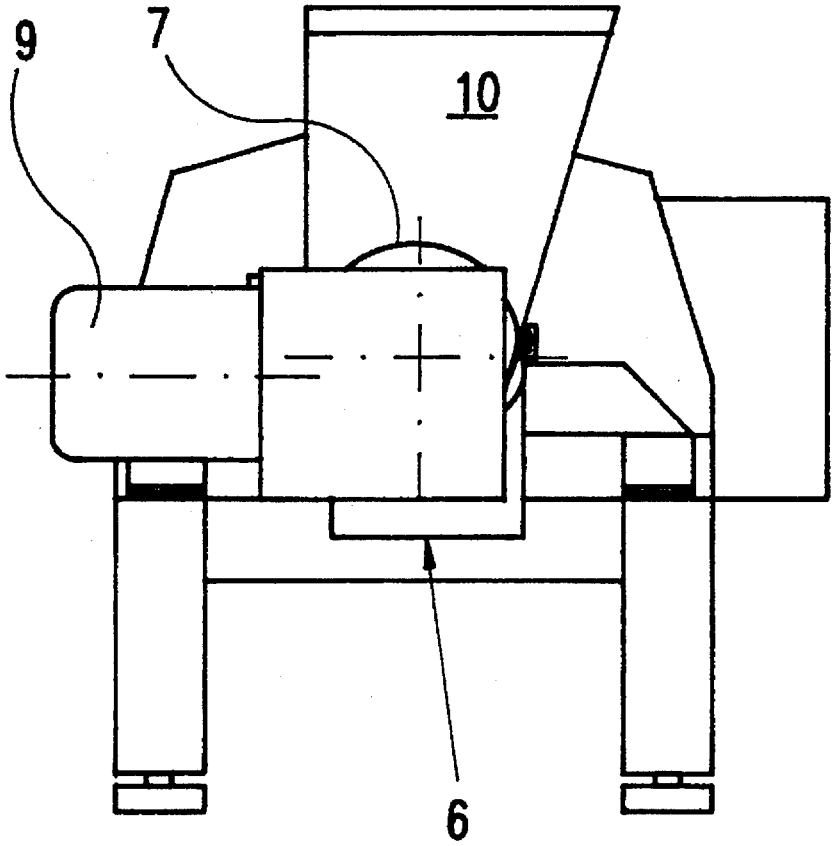
FIG. 3 is the item according to FIGS. 1 and 2 in a front view.
Figure 4:
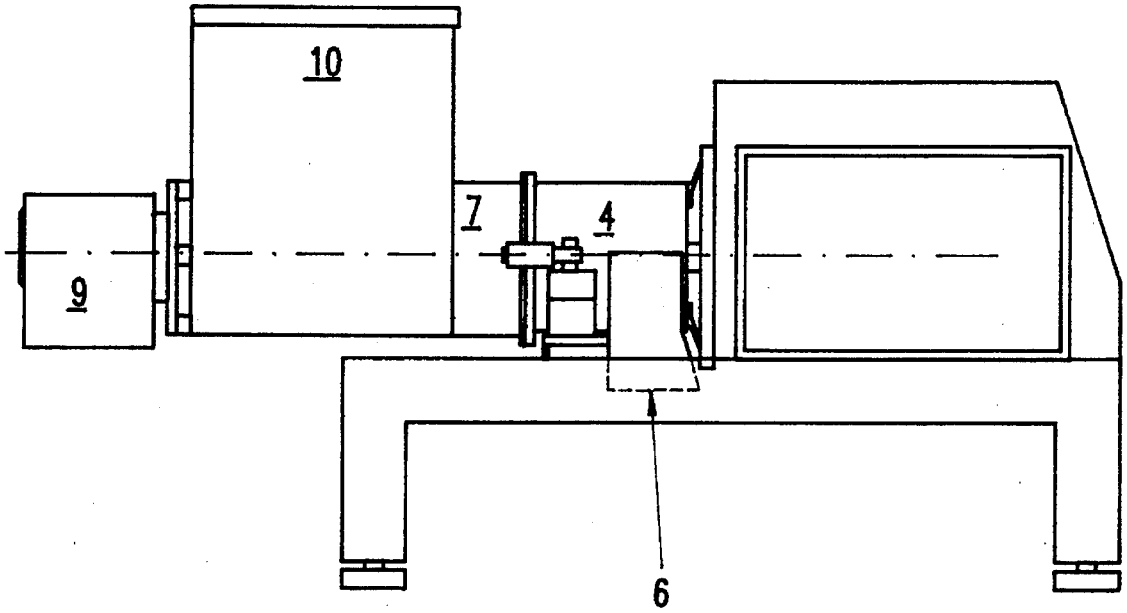
FIG. 4 is the item according to FIG. 1 in a side view.
Figure 11:
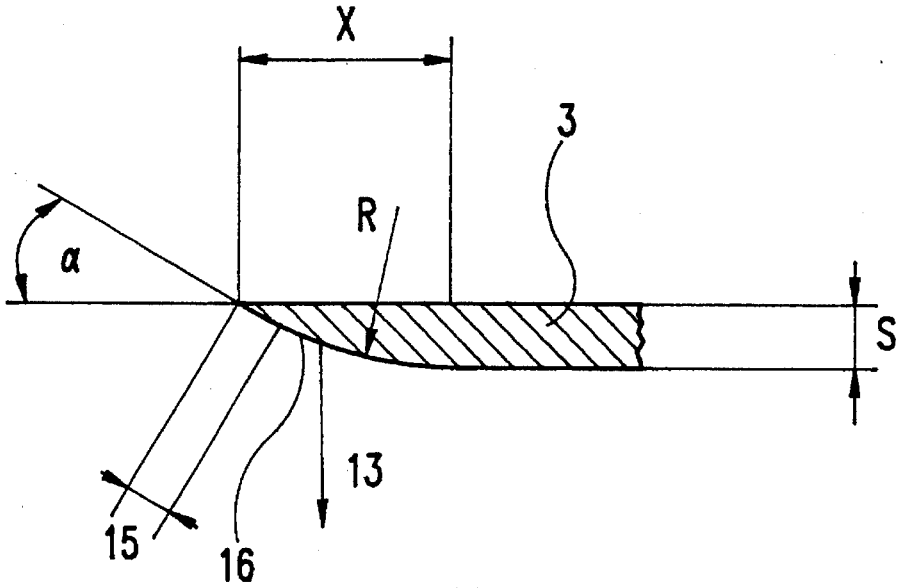
Figure 13:
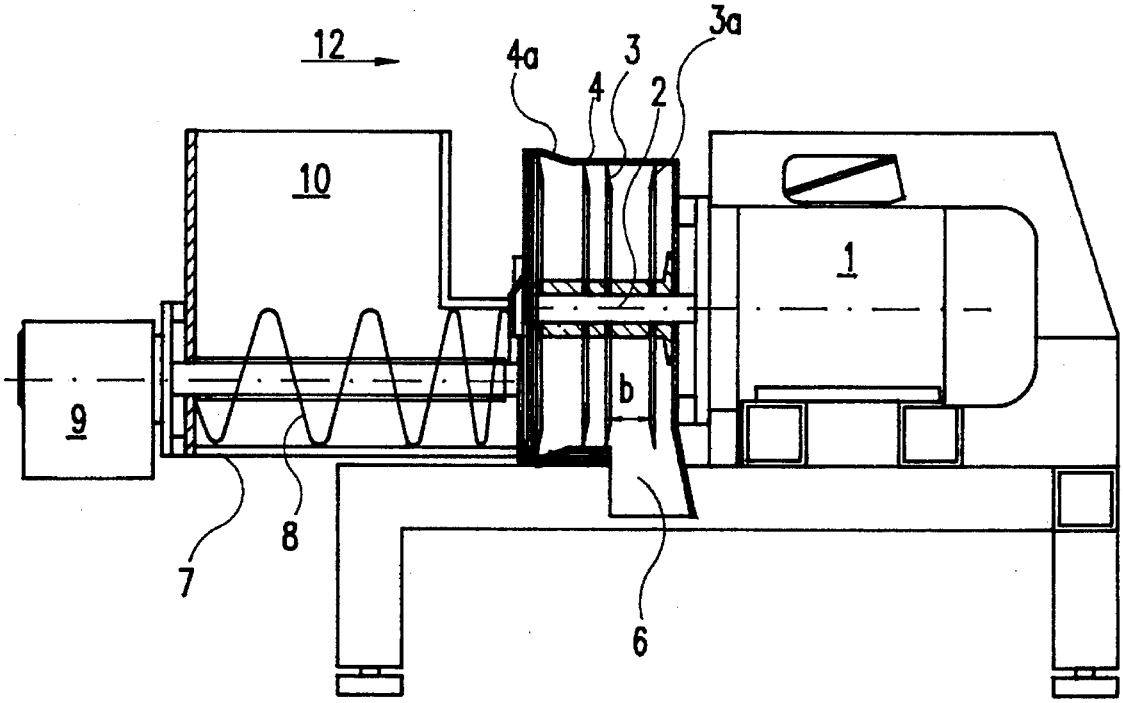
Figure 12:
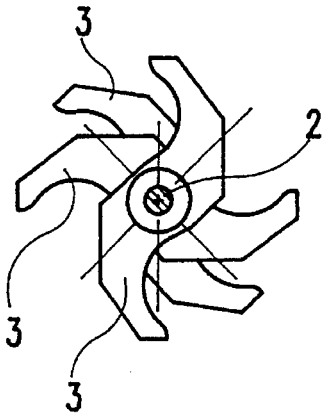

FIG. 11, on an enlarged scale once again, shows a cross section through the blades of a double cutter;

FIG. 12 shows in front view one of three cutter sets composed of double cutters arranged in a row with axial spacing between them; and FIG. 13 shows a modified embodiment in a view according to FIG. 1.

The cutting machine shown in FIGS. 1 to 4 comprises a three-phase motor 1 with a horizontally aligned shaft stub 2, on which cutters 3, 3*a* are mounted nonrotatably but readily interchangeably, said cutters rotating in a cutter housing 4. In the bottom of cutter housing 4, immediately in front of motor shield 5, a delivery opening 6 open at the bottom is provided.

Cutter housing 4 is preceded by a screw housing 7, in which a feed screw 8 rotates, said screw being flush with shaft stub 2 supporting the cutter shaft and also having a three-phase motor as a drive. Screw housing 7 is flush at its lower edge with the lower edge of cutter housing 4 and has in its upper front side a feed hopper 10 for the product to be cut. Its wall facing cutter housing 4 together with the upper wall of feed screw housing 7 forms a cutting edge 10*a* for coarse grinding of large pieces of meat.

It is evident from FIG. 1 in particular that in this embodiment the diameter of feed screw 8 roughly corresponds to the diameter of cutters 3, 3*a*.

Each of the two three-phase motors 1,9 can be fitted with a frequency converter connected ahead of it to regulate the rotational speed.

The product in pieces to be ground, the example frozen pieces of meat with an edge length of maximum 250×250×250 mm, is fed in a continuous product stream into feed hopper 10 and then sent to the conveyor area of feed screw 8. Overly large pieces of product are crushed by feed screw 8. In addition, the pieces of product are fed in the form of a product strand directly to rotating cutters 3, 3*a*, which are mounted on shaft stub 2 with an axial clearance between them but leave the outlet cross section of delivery opening 6 largely free. In the vicinity of delivery opening 6, only a single cutter 3*a* is provided. Feed screw 8 rotates at 20 to 200 rpm, while cutters 3, 3*a* rotate in the opposite direction at rotational speeds between 500 and 3000 rpm. The pieces of product fed to cutters 3, 3*a* by feed screw 8 are cut in cutter housing 4 with minimum possible emulsification, free of lumps, to a grain size of 2 to 8 mm.

Figure 5:
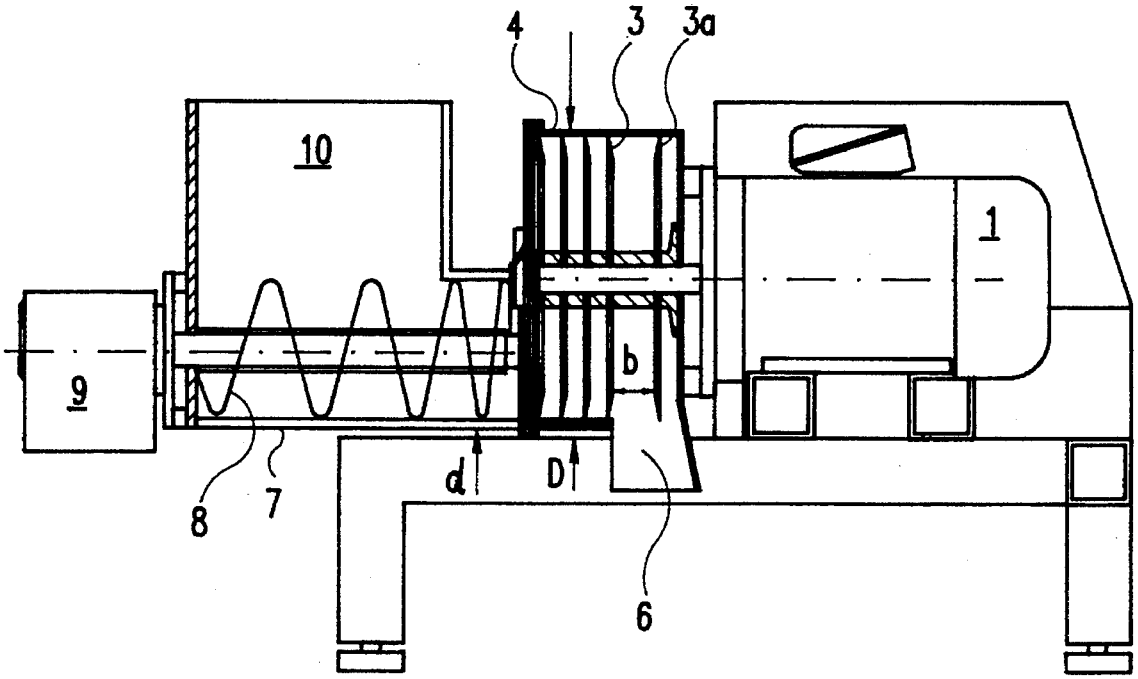
FIG. 5 is a modified embodiment in a view according to FIG. 1.
Figure 6:
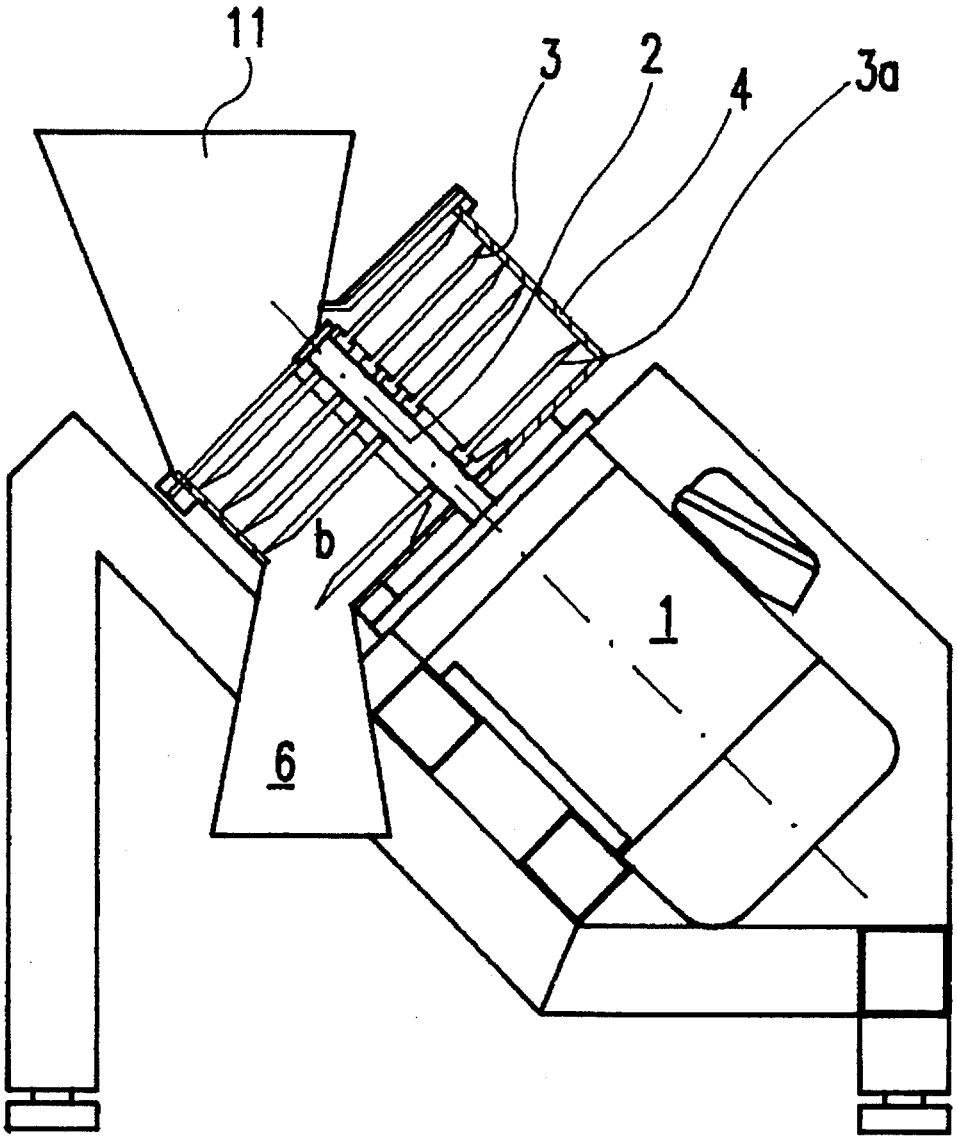
FIG. 6 is another modified embodiment in a view according to FIG. 1.
Figure 7:
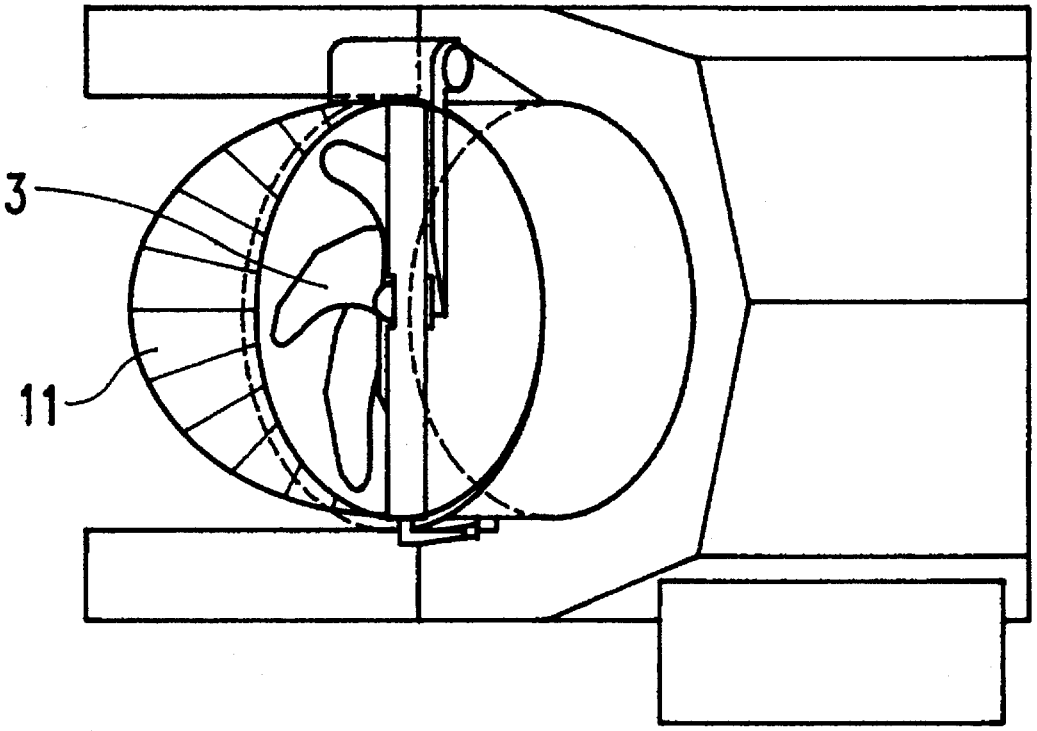
FIG. 7 is the item in FIG. 6 in a top view.
Figure 8:
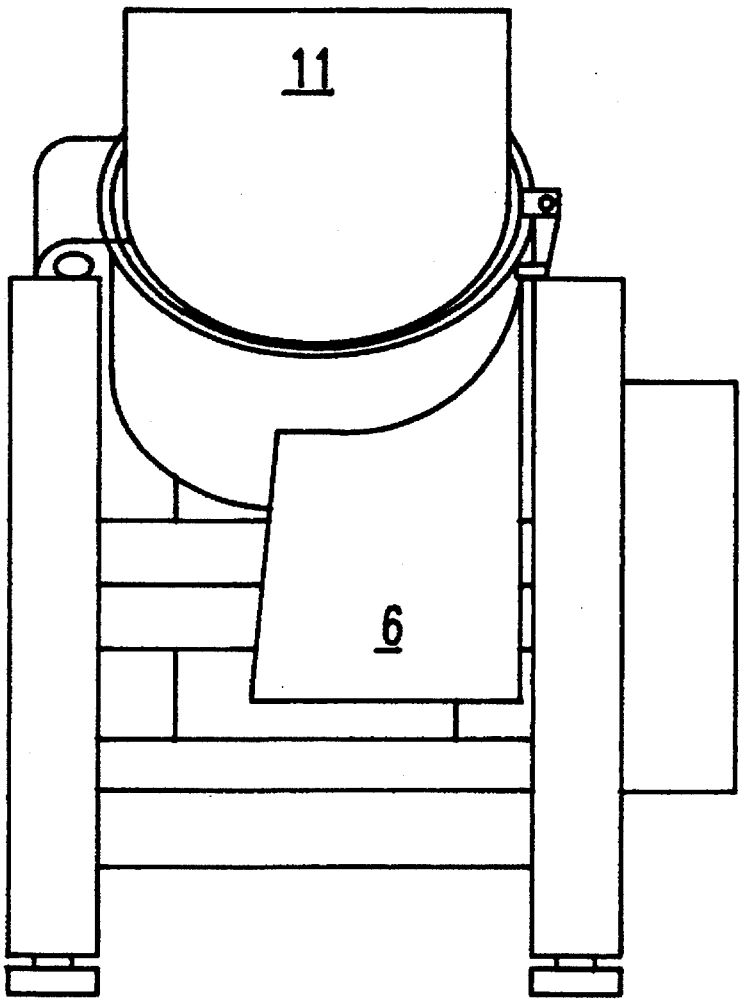
FIG. 8 is the item in FIG. 6 in a front view.
Figure 9:
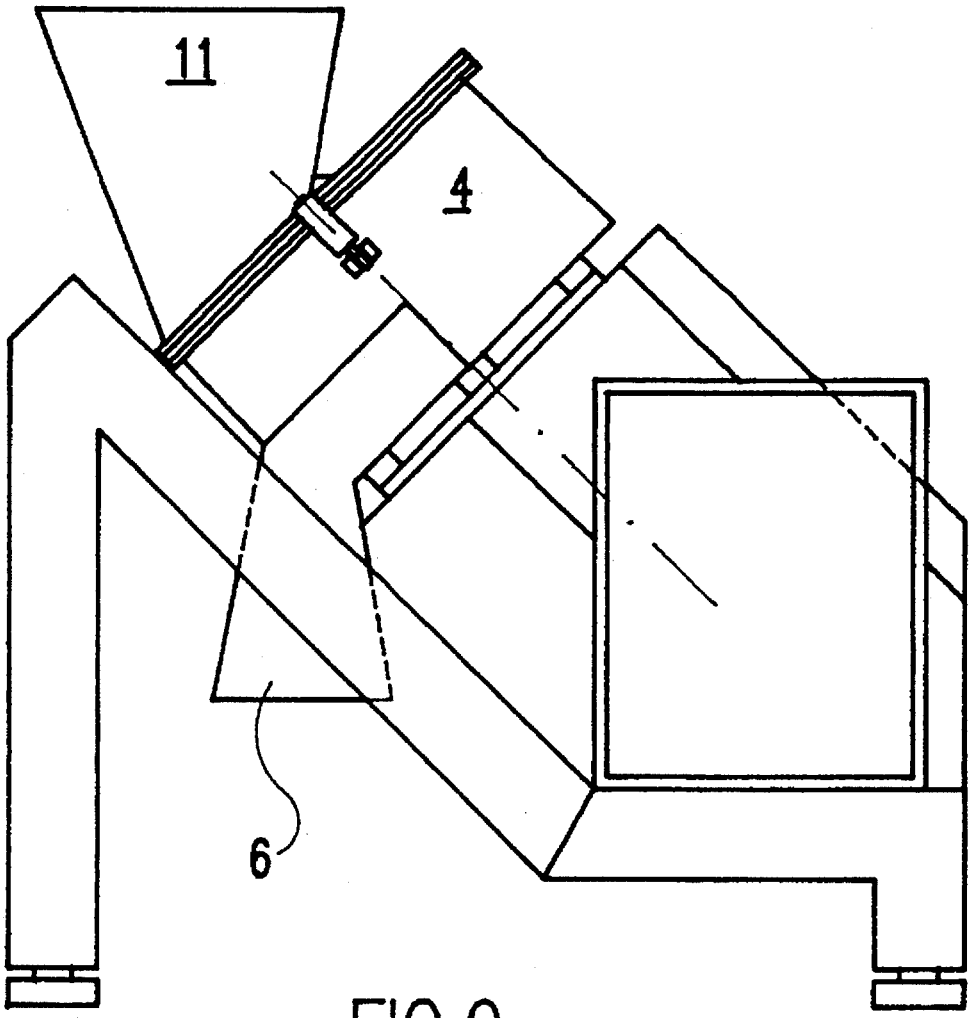
FIG. 9 is the cutting machine according to FIG. 6 in a side view.

The embodiment shown in FIG. 5 differs from that in FIG. 1 only in that screw housing diameter d corresponds to only about half cutter housing diameter D. The diameter of feed screw 8 thus corresponds roughly to the radius of cutter sets 3, 3*a*.

The modified embodiment shown in FIGS. 6 to 9 differs from the one in FIGS. 1 to 4 mainly in two features:

Three-phase motor 1 has its shaft stub 2 inclined at approximately 45° to the horizontal, and instead of a feed screw being used, the pieces of product to be crushed are fed by gravity through a feed hopper 11 directly into the working area of cutter sets 3.

Figure 10:
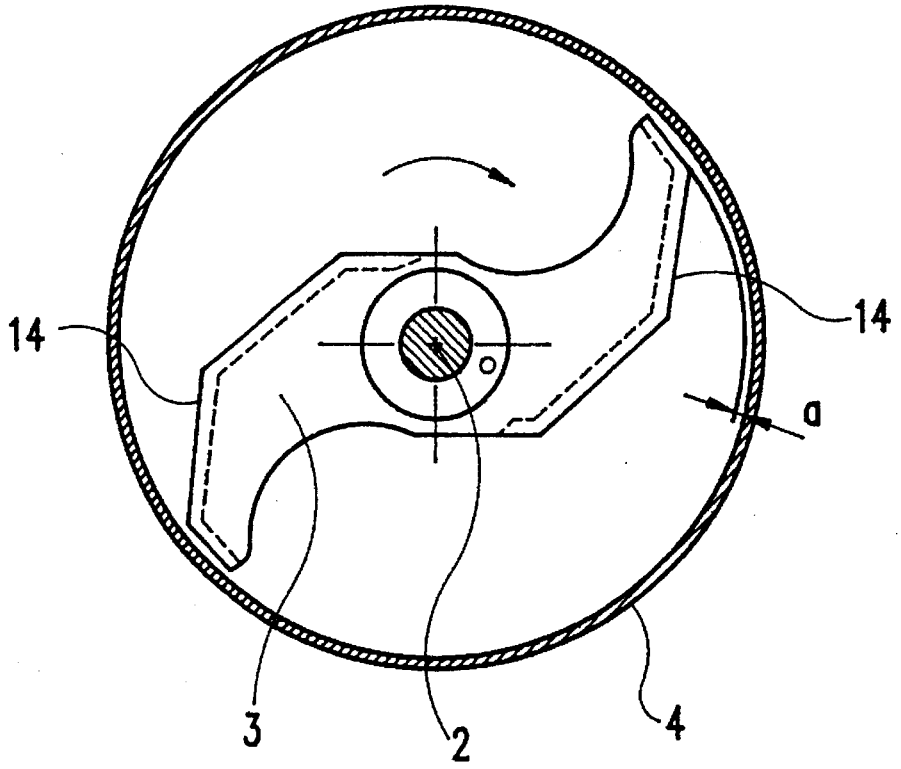
FIG. 10 shows on an enlarged scale, a cross section through a cutter housing with a double cutter rotating therein.

FIG. 10 shows that cutters 3 are designed as double cutters, both of whose blades are provided on their leading edges 14 with a chamfer 15 with a grinding "angle a" of approximately 25° to 30° (see also FIG. 11). This grinding "angle a" is chosen to correspond to the product to be cut. Dull cutters are reground at this "angle a". "The radial distance (a) of the ends of rotating cutters (3,3*a*) from the inside wall of cutter housing (4) is approximately 2 to 4 mm." FIG. 11 shows that chamfer 15 itself is made only relatively short and then makes a transition to a crowned conveyor sulfite 16 that has a radius R and extends over width x. This conveyor surface 16 lends the product the above-mentioned conveyor component 13. The length of chamfer 15 can be about 2 mm; with x in the 25 to 40 mm range; the thickness S of a cutter 3 can be between 6 and 10 mm.

A set of cutters preferably consists or 3 to 5 double cutters, which are shown in FIG. 12 as arranged staggered circumferentially with respect to one another.

In the modified embodiment shown in FIG. 13, first section 4*a* of cutter housing 4, looking in feed direction 12, tapers slightly in diameter to produce a blocking effect. In this proposed solution, the first cutter of the cutter set has a larger diameter than the following cutter in order to maintain a constant radial distance a from cutter housing 4.

We claim:

1. A device for cutting edible products in the form of lumps, especially frozen pieces of meat having dimensions up to 250 mm×250 mm×250 mm, said device comprising:

cutters for rotating in a cutter housing, said cutters being mounted nonrotatably but readily interchangeably on a shaft stub of a three-phase motor, said shaft stub being horizontal or inclined relative to a horizontal plane;

each cutter of said cutters having an axial conveyor component;

said cutters or rotating at rotational speeds between 500 rpm and 3,000 rpm;

said cutters having a configuration and an axial spacing such that said frozen pieces of meat are cut to granulated meat having a grain size of 2 to 8 y mm;

wherein a plurality of said cutters comprise double cutters having two blades, each blade of said blades including a chamfer provided at a leading edge, said chamfer having a grinding angle between approximately 25° and approximately 30°;

said cutter housing having a delivery opening in a lowest area, for continuous delivery of said granulated meat by gravitational force only;

said cutter housing being adjacent a continuously operating feeding device comprising a feed screw for feeding the frozen pieces of meat against a plane of rotation of a first cutter of said cutters, said feed screw for rotating at a rotational speed between 20 rpm and 200 rpm in a direction opposite to that of said cutters, said cutter housing having an inside wall circumferentially encompassing said cutters, and said inside wall being smooth, wherein a radial distance between ends of said rotating cutters and said inside wall comprises a gap distance of less than approximately 4 mm, wherein a lower edge of a housing of said feed screw is flush with a lower edge of said cutter housing; and wherein a first diameter of a feed screw housing corresponds to approximately half a second diameter of said cutter housing.

2. A device according to claim 1, wherein said feed screw housing of said feed screw has in an upper side, one of a loading shaft and a feed hopper wherein a wall facing said cutter housing forms a cutting edge with an upper wall of said feed screw housing for coarse crushing of said frozen pieces of meat.

3. A device according to claim 1, wherein the feed screw is driven by a second three-phase motor having a frequency converter to control said rotational speed of said feed screw.

4. A device according to claim 1, further comprising a frequency converter connected to said motor for rotating said cutters for controlling said rotational speed of said cutters.

5. A device according to claim 1, wherein a first section of said cutter housing adjacent said feeding device has a tapered diameter.

6. A device according to claim 1, wherein said gap distance is between approximately 2 mm and approximately 4 mm.

7. A device according to claim 1, wherein a final cutter of said cutters is positioned a second axial spacing downstream from an adjacent cutter, wherein said second axial spacing corresponds to a fraction of a size of said delivery opening, said final cutter including a conveyor component directed in a direction opposite to said axial conveyor component of said cutters.

8. A device according to claim 1, wherein said blades of said double cutters include a crowned conveyor surface abutting said chamfer.

9. A device for cutting edible products in a continuous fashion, comprising:

a cutter housing having entrance and exit openings;

a plurality of cutters positioned within said cutter housing between said entrance and exit openings on a rotatable shaft, at least one of said cutters being disengageable from said rotatable shaft and selectively positionable on said rotatable shaft, each of said cutters being sized and spaced apart to allow an axial clearance between each of said cutters and a housing clearance between said cutters and said cutter housing, each of said cutters including a leading edge positioned to cut edible products as said cutter is rotated, and each of said cutters including a conveyor surface positioned at a point on said cutter for providing axial movement of said edible products towards said exit opening of said cutter housing;

said device further comprising means for rotating said rotatable shaft; and continuous feed means for feeding said edible products into said entrance opening of said cutter housing, said cutter housing having an inside wall circumferentially encompassing said cutters, and said inside wall being smooth, wherein a radial distance between ends of said cutters and said inside wall comprises a gap distance on the order of 2 millimeters to 4 millimeters.

10. The device of claim 9, wherein said continuous feed means comprises:

a container for collecting edible products positioned adjacent said cutter housing;

a feed screw positioned within said container for driving said edible products from said container into said entrance opening of said cutter housing; and feed screw drive means for causing said feed screw to rotate about a longitudinal axis, whereby said edible products are directed by said feed screw into said entrance opening of said cutter housing.

11. The device of claim 9, wherein said continuous feed means comprises a directing means for allowing a gravitational force to act on said edible products and force said edible products into said entrance opening of said cutter housing.

12. The device of claim 9, wherein said means for rotating said rotatable shaft causes rotation of said cutters positioned on said rotatable shaft at rotation speeds between 500 rpm and 3000 rpm.

* * * * *